US006843583B2

(12) United States Patent
Winter

(10) Patent No.: US 6,843,583 B2
(45) Date of Patent: Jan. 18, 2005

(54) DEVICE FOR STORING AND DISPLAYING DECORATIVE LIGHT STRINGS

(76) Inventor: Sita H. Winter, 11083 W. Burnett Rd., Sun City, AZ (US) 85373

( * ) Notice: Subject to any disclaimer, the term of this patent is extended or adjusted under 35 U.S.C. 154(b) by 25 days.

(21) Appl. No.: 10/309,382

(22) Filed: Dec. 2, 2002

(65) Prior Publication Data

US 2004/0105263 A1 Jun. 3, 2004

(51) Int. Cl.[7] ..... F21V 21/00

(52) U.S. Cl. ..... 362/249; 362/233; 362/370; 362/399; 362/427; 362/429; 362/806; 362/151

(58) Field of Search ..... 362/151, 249, 362/233, 362, 368, 370, 375, 382, 399, 427, 428, 418, 429, 806, 145

(56) References Cited

U.S. PATENT DOCUMENTS 4,941,071 A * 7/1990 Knauf ..... 362/133
4,977,490 A * 12/1990 Davies ..... 362/221
5,345,369 A * 9/1994 Ruud et al. ..... 362/145
5,510,966 A * 4/1996 Konecny ..... 362/249
6,050,709 A * 4/2000 Hastings ..... 362/375
6,088,967 A * 7/2000 Johnson ..... 52/28
6,543,915 B1 * 4/2003 Chen ..... 362/427

* cited by examiner

*Primary Examiner*—Stephen Husar
*Assistant Examiner*—Sharon Payne
(74) *Attorney, Agent, or Firm*—Jeffrey D. Moy; Harry M. Weiss; Weiss, Moy & Harris, P.C.

(57) ABSTRACT

A device for storing and displaying decorative light strings has a stationary upper body mountable to the eaves of a house or the like and a lower body. The lower body is rotatably connected with the upper body and dimensioned to fit inside the upper body. The lower body houses the decorative light string. In storage position, the decorative light string is completely enclosed and therefore protected from the natural elements. Using a handle, the lower body can be rotated and the light bulbs will be displayed.

11 Claims, 1 Drawing Sheet

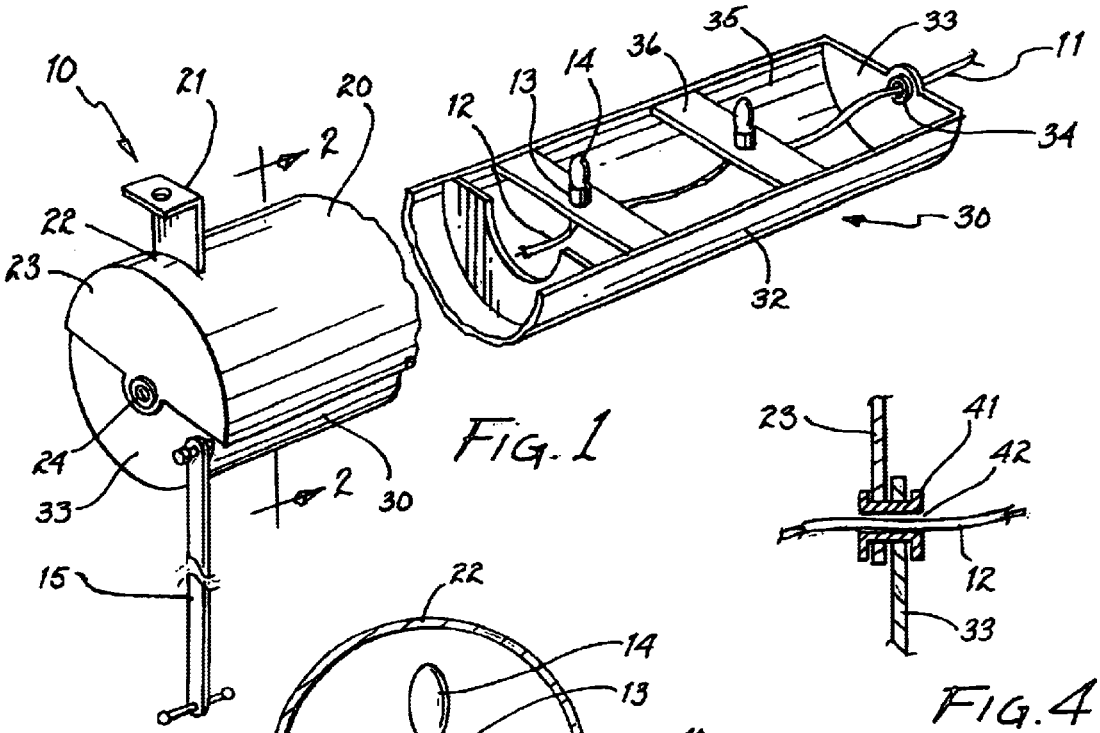
FIG. 1
FIG. 4
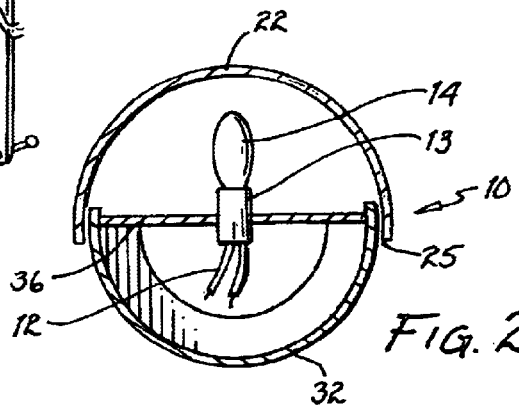
FIG. 2
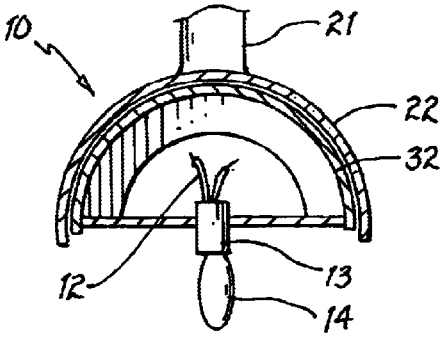
FIG. 3
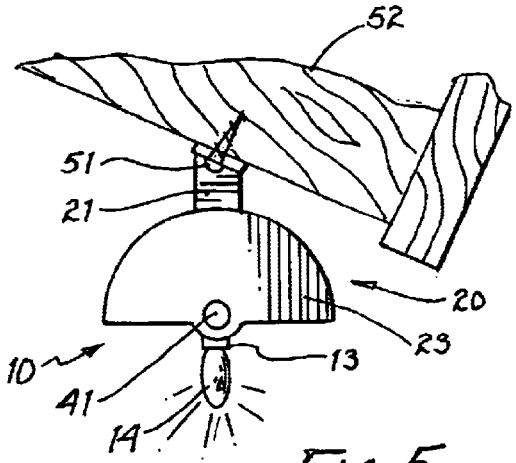
FIG. 5

DEVICE FOR STORING AND DISPLAYING DECORATIVE LIGHT STRINGS

BACKGROUND OF THE INVENTION

1. Field of the Invention

This invention relates generally to storage devices and, more specifically, to a device for storing and displaying decorative light strings.

2. Description of the Prior Art

Presently, most decorative light strings are mounted to eaves, fences, trees and bushes, etc. outside the houses. These decorative light strings are generally displayed only during the holiday season. Therefore, the light strings need to be taken out of storage and mounted to the eaves and the like at the beginning of each holiday season. Subsequently, the light strings need to be taken down and put back into storage at the end of each holiday season. The process of mounting and dismounting of the light strings proves often to be burdensome, inconvenient, and time consuming.

Another problem associated with these decorative light strings is that when storing them, the light strings have a tendency to get tangled. The tangling problem is particularly encountered and more severe with icicle light strings. The icicle light strings have wires with lights attached branching out from a main wire. Thus, it is desirable to have a device for the storage of the light strings which should be tangle free, breakage free and provide for a fast and easy re-use of the light strings.

The prior art provides various devices for storing light strings where the light string usually is wound around a base. Winding up the light strings accordingly is inconvenient and time consuming and does not always prevent breakage and tangling, especially when used for icicle light strings. Furthermore, these prior art devices do not solve the problem of still needing to mount and dismount to the eaves and the like the light strings each holiday season.

Therefore a need exists to provide a device for storing and displaying decorative light strings. The device for storing and displaying decorative light strings should eliminate the task of mounting and dismounting the light strings each holiday season and that further provides a tangle and damage free storage of the light strings between the holiday seasons.

SUMMARY OF THE INVENTION

An object of the present invention is to provide a device for storing and displaying decorative light strings.

It is a further object of the present invention to provide a device for storing and displaying decorative light strings that houses the light string and can be permanently mounted to eaves and the like outside a house.

It is still a further object of the present invention to provide a device for storing and displaying decorative light strings that allows an easy transition from displaying the lights to storing the lights and vice versa.

It is still a further object of the present invention to provide a device for storing and displaying decorative light strings that has a simple mechanical design, works reliably, requires relatively low maintenance, is relatively inexpensive, and is easy to use.

BRIEF DESCRIPTION OF THE PREFERRED EMBODIMENTS

In accordance with one embodiment of the present invention, a device for storing and displaying decorative light strings is disclosed. The device for storing and displaying decorative light strings comprises an upper body including a plurality of mounting brackets; a lower body rotatably connected with the upper body; and a handle. The lower body is dimensioned to fit inside the upper body. The lower body further comprises a plurality of support bars for holding the decorative light string in place. In storage position, the decorative light string is completely enclosed and therefore protected from the natural elements. Using a handle, the lower body can be rotated to display the light bulbs.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

FIG. 1 is an elevated perspective view of the device for storing and displaying decorative light strings according to the present invention with a section of the device cut away.

FIG. 2 is a cross-sectional side view taken along line 2—2 of FIG. 1.

FIG. 3 is a second cross-sectional side view of the device of the present invention with the light string in a stored position.

FIG. 4 is a horizontal cross-sectional view of the rivet portion of the device for storing and displaying decorative light strings according to the present invention.

FIG. 5 is a side view of the device for storing and displaying decorative light strings according to the present invention mounted to eaves.

DETAILED DESCRIPTION OF THE PREFERRED EMBODIMENTS

Referring to FIG. 1, a device 10 for storing and displaying decorative light strings 11 according to the present invention is shown. The device 10 for storing and displaying decorative light strings 11 generally comprises, in combination: an upper body 20 having a plurality of mounting brackets 21 rigidly attached to it, a lower body 30, and a handle 15. The decorative light strings 11 can be either standard outdoor light strings or icicle light strings. The upper body 20 comprises a semicircular molded top wall 22, two sidewalls 23, and an open bottom 25. The upper body 20 can be permanently mounted to the eaves 52 of a house or similar structures by fastening the mounting brackets 21 to the wood of the eaves 52 or similar structures using a plurality of screws 51, as shown in FIG. 5. The sidewalls 23 are semicircular shaped and have an aperture 24.

Still referring to FIG. 1, the lower body 30 comprises a semicircular molded top wall 32, two sidewalls 33, and an open bottom 35. The lower body 30 is dimensioned to fit inside the upper body 20. The sidewalls 33 are semicircular shaped and have an aperture 34. The lower body 30 is rotatably connected with the upper body 20 by a rivet 41 placed inside the apertures 24 and 34. A centered aperture 42 of the rivet 41 accommodates the wire 12 of the light string 11, as shown in detail in FIG. 4. The size of the aperture 24 is chosen such that the wire 12 will not become damaged when the lower body 30 is rotated. The wire 12 of the light string 11 extends beyond the centered aperture 42 and can be connected to an electrical outlet or to a second decorative light string 11 in a second device 10.

Still referring to FIG. 1, the lower body 30 further comprises a plurality of support bars 36 proximate to the bottom 35 and evenly spaced over the full length of the lower body 30. Each support bar 36 provides an opening for receiving a light socket 13. The light socket 13 can be removably attached to the support bar 36 with the light bulb 14 facing towards the outside of the lower body 30. The lower body 30 can be rotated, and therefore moved into and out of the stationary upper body 20, using the handle 15.

Now referring to FIG. 2, a cross-sectional view of the device 10 for storing and displaying decorative light strings 11 in storage position according to the present invention is shown. In storage position, the top wall 32 of the lower body 30 is facing down. The upper body 20 and the lower body 30 are now forming a housing enclosing the decorative light string 11 completely. The light bulbs 14 are pointing up towards the ceiling of the stationary upper body 20. While in the storage position, the light bulbs 14, the light sockets 13, and the wire 12 of the decorative light string 11 are protected from the natural elements such as wind, rain, snow, hail, and the like.

Using the handle 15, the lower body 30 can be rotated and therefore moved upwards into the upper body 20. The device 10 for storing and displaying decorative light strings 11 is now in display position, as shown in FIG. 3. In display position, the light bulbs 14 are facing down and the house or the like can be illuminated. Still, even in the display position, the wire 12 and the light sockets 13 of the decorative light string 11 are protected from the natural elements such as wind, rain, snow, hail, and the like, since they are located inside the lower body 30 that is now positioned inside the upper body 20.

By providing the device 10, decorative light strings can be securely stored without being tangled or otherwise damaged. After the device 10 has been permanently installed, for instance mounted to the eaves 52 of a house, the transition between storage position and display position is relatively easy, fast, and effortless. Since the device 10 has a simple mechanical design it is relatively inexpensive and maintenance free. It is relatively easy to replace a decorative light string 11, should it become necessary, since the light sockets 13 are removably attached to the support bars 36 inside the lower body 30. Further, the display position provides easy access for replacing defective light bulbs 14. By using more than one devices 10, the decorative light strings 11 can be mounted with changing directions or around corners and the like.

By providing the device 10 for storing and displaying decorative light strings 11 problems associated with prior art devices are solved.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A device for storing and displaying decorative light strings comprising, in combination:

an upper body including a plurality of mounting brackets, wherein said upper body further comprises:

a semicircular molded top wall;

a pair of semicircular shaped sidewalls having an aperture; and an open bottom;

a lower body rotatably connected with said upper body; and a handle coupled to the lower body.

2. The device for storing and displaying decorative light strings of claim 1, wherein said lower body further comprises:

a semicircular molded top wall;

a pair of semicircular shaped sidewalls having an aperture; and an open bottom.

3. The device for storing and displaying decorative light strings of claim 2, wherein said lower body further comprises a plurality of support bars evenly spaced proximate to said open bottom.

4. The device for storing and displaying decorative light strings of claim 3, wherein said support bars further comprise an opening for receiving a light socket.

5. The device for storing and displaying decorative light strings of claim 1, wherein said lower body is dimensioned to fit inside said upper body.

6. The device for storing and displaying decorative light strings of claim 1, further comprising a rivet connecting said upper body with said lower body.

7. The device for storing and displaying decorative light strings of claim 6, wherein said rivet has a centered aperture dimensioned to accommodate a wire of said decorative light string.

8. A device for storing and displaying decorative light strings comprising, in combination:

an upper body including a plurality of mounting brackets, wherein said upper body further comprises:

a semicircular molded to wall;

a pair of semicircular shaped sidewalls having an aperture; and an open bottom;

a lower body rotatably coupled with said upper body wherein said lower body is dimensioned to fit inside said upper body;

a plurality of support bars evenly spaced proximate to an open bottom of said lower body wherein each of said support bars has an opening for receiving a light socket; and a handle coupled to the lower body to rotatably move the lower body.

9. The device for storing and displaying decorative light strings of claim 8, wherein said lower body further comprises:

a semicircular molded top wall;

a pair of semicircular shaped sidewalls having an aperture; and an open bottom.

10. The device for storing and displaying decorative light strings of claim 8, further comprising a rivet connecting said upper body with said lower body.

11. The device for storing and displaying decorative light strings of claim 10, wherein said rivet has a centered aperture dimensioned to accommodate a wire of said decorative light string.

* * * * *